US012569779B2

(12) United States Patent
Xu

(10) Patent No.: US 12,569,779 B2
(45) Date of Patent: Mar. 10, 2026

(54) BUBBLE-BLOWING TOY

(71) Applicant: Shenzhen Dingming Technology Limited, Guangdong (CN)

(72) Inventor: Zhifeng Xu, Guangdong (CN)

(73) Assignee: Shenzhen Dingming Technology Limited, Shenzhen (CN)

( * ) Notice: Subject to any disclaimer, the term of this patent is extended or adjusted under 35 U.S.C. 154(b) by 0 days.

(21) Appl. No.: 19/172,871

(22) Filed: Apr. 8, 2025

(65) Prior Publication Data

US 2025/0332523 A1 Oct. 30, 2025

Related U.S. Application Data

(63) Continuation of application No. 18/677,936, filed on May 30, 2024.

(30) Foreign Application Priority Data

Apr. 29, 2024 (CN) ..... 202420933348.5

(51) Int. Cl.
*A63H 33/28* (2006.01)

(52) U.S. Cl.
CPC ..... *A63H 33/28* (2013.01)

(58) Field of Classification Search
CPC ..... A63H 33/28; A63H 23/00; A63H 23/10
See application file for complete search history.

(56) References Cited

U.S. PATENT DOCUMENTS 4,515,572 A * 5/1985 Emms ..... A63H 23/10 446/176
4,689,032 A * 8/1987 Trossman ..... A63H 23/10 446/160

(Continued)

FOREIGN PATENT DOCUMENTS

CN 109331478 A * 2/2019 ..... A63H 23/12
CN 209490484 U * 10/2019

(Continued)

OTHER PUBLICATIONS

Translation CN209490484U (Year: 2019).*
Translation CN217786623U (Year: 2022).*
Translation CN109331478A (Year: 2019).*

*Primary Examiner* — Eugene L Kim
*Assistant Examiner* — Alyssa M Hylinski

(57) ABSTRACT

The present application relates to the technical field of toys and related products, in particular to a bubble-blowing toy. The bubble-blowing toy is provided with an air guide mechanism that allows the bubble-making head to adapt to the varying liquid level in the tray, addressing the issue of limited bubbles in existing bubble-blowing toys and enhancing the user experience. Specifically, the bubble-blowing toy is provided with an auxiliary floating assembly connected to the bubble-making head, allowing the bubble-making device to adjust its position according to the change of the liquid level. This allows the air outlet to be close to or in contact with the liquid surface of the foam liquid, thereby ensuring that the expelled airflow can fully contact or stir the foam liquid to generate a significant amount of bubbles, enhancing the user experience.

12 Claims, 16 Drawing Sheets

A–A

(56) References Cited

U.S. PATENT DOCUMENTS

| | | | | | |
|---|---|---|---|---|---|
| 5,823,121 | A * | 10/1998 | Reiter | A47B 37/00 | 108/150 |
| 6,752,679 | B1 * | 6/2004 | Lui | A63H 3/16 | 446/69 |
| 2002/0061697 | A1 * | 5/2002 | Hornsby | A63H 33/28 | 446/15 |
| 2023/0233956 | A1 * | 7/2023 | Lin | A63H 33/28 | 446/15 |

FOREIGN PATENT DOCUMENTS

| | | | | |
|---|---|---|---|---|
| CN | 111577633 | A * | 8/2020 | F04D 29/002 |
| CN | 217786623 | U * | 11/2022 | |

* cited by examiner

A–A

BUBBLE-BLOWING TOY

CROSS REFERENCE TO RELATED APPLICATIONS

The present application is a Continuation Application of U.S. application Ser. No. 18/677,936 filed on May 30, 2024, which claims the benefit of Chinese Patent Application No. 202420933348.5 filed on Apr. 29, 2024, the contents of which are incorporated herein by reference in their entirety.

TECHNICAL FIELD

The present application relates to the field of toys and related products, in particular to a bubble-blowing toy.

BACKGROUND TECHNOLOGY

A bubble-blowing toy is a children's product that can automatically blow out bubbles. It primarily consists of a fan and a bubble-making device connected to the fan. When in use, the bubble-making device directs the airflow provided by the fan to the foam liquid, generating bubbles. This makes it very convenient to use.

Currently, there are two primary installation methods for the bubble-making device of bubble-blowing toys: positioning the air outlet of the bubble-making device either above or at the very bottom of the liquid surface of the foam liquid.

During use, the consumption of foam liquid causes the liquid level to drop. If the first installation method is employed, the air outlet gradually moves away from the liquid surface, preventing the airflow from fully contacting the foam liquid. If the second installation method is chosen, the foam liquid decelerates the air flow speed, hindering the airflow's ability to adequately stir the foam liquid. Both methods therefore affect the quantity of bubbles produced and provide a poor user experience.

Application Content

The technical issue addressed by the embodiments of the present application is to provide a bubble-blowing toy that resolves the problems of limited bubble production and poor user experience in the prior art.

A bubble-blowing toy provided by the embodiments of the present application includes:

- an air supply mechanism, including an air exhaust port and a fan for guiding external air to blow out from the air exhaust port;
- a tray, provided with a liquid-carrying cavity for holding foam liquid, and the liquid-carrying cavity having a bubble outlet connected to an outside;
- a bubble-making device, including a bubble-making head located in the tray and an air guide mechanism connecting the bubble-making head to the air exhaust port, the bubble-making head being provided with an air outlet, and the air guide mechanism being configured to allow the bubble-making head to adapt to a varying liquid level of the foam liquid in the tray; and
- an auxiliary floating assembly connected to the bubble-making head to keep the air outlet of the bubble-making head close to or in contact with the liquid level of the foam liquid;
- the auxiliary floating assembly comprises a support frame and a floating ball, the support frame is installed on the bubble-making head, and the floating ball is installed on the support frame;
- two floating balls are symmetrically installed on both sides of the support frame.

Optionally, the bubble-blowing toy further includes: a housing, the air supply mechanism being installed in the housing, the housing being provided with a first connecting piece; the tray being provided with a second connecting piece corresponding to the first connecting piece; and one of the first connecting piece and the second connecting piece being a magnet, and an other of the first connecting piece and the second connecting piece being a metal that is capable of being attracted by the magnet or a magnet, allowing the tray to be detachably installed on the housing.

Optionally, the housing includes a base plate, a partition, and an outer shell; the partition and the outer shell are installed on an upper side of the base plate, and an accommodation cavity is formed by enclosing the partition, the outer shell, and the base plate, with a lower side of the base plate located outside the accommodation cavity; the air supply mechanism is installed in the accommodation cavity; the bubble-making device is movably installed on the partition; and the tray is detachably installed on the lower side of the base plate.

Optionally, the bubble-blowing toy further includes: a control panel provided in the accommodation cavity and electrically connected to the air supply mechanism; a power supply cavity provided on the base plate; and a battery installed in the power supply cavity and electrically connected to the control panel.

Optionally, the bubble-blowing toy further includes: a light-emitting part installed on the outer shell and arranged corresponding to the bubble outlet, and the light-emitting part being electrically connected to the control panel.

Optionally, the air guide mechanism includes a ventilation tube and a movable cylinder; one end of the ventilation tube is connected to the air exhaust port, and an other end of the ventilation tube extends into the liquid-carrying cavity and connects to the movable cylinder; and the bubble-making head is slidably sleeved on the movable cylinder, allowing the bubble-making head to slide along the movable cylinder as the liquid level changes.

Optionally, the partition is provided with a through hole, a sidewall, on an end connected to the air exhaust port, of the ventilation tube, is provided with a clamping slot, and the through hole is snapped into the clamping slot to prevent the ventilation tube from detaching from the partition.

Optionally, the air guide mechanism includes a flexible tube; and one end of the flexible tube is connected to the air exhaust port, and an other end of the flexible tube is connected to the bubble-making head.

Optionally, the air outlet are provided with multiple air outlets circumferentially arrayed on the bubble-making head, and a flow guide cavity is formed by enclosing the support frame and the bubble-making head; the multiple air outlets are connected to the flow guide cavity simultaneously.

Optionally, the auxiliary floating assembly further includes a floating block installed in the flow guide cavity and staggered with the multiple air outlets, preventing the foam liquid from filling the flow guide cavity to increase a weight of the bubble-making head and also enhance a buoyancy of the bubble-making head; an end of the movable cylinder close to the bubble-making head is provided with a protrusion, when the bubble-making head approaches the movable cylinder, the protrusion abuts the floating block, preventing the floating block from blocking the movable cylinder.

Optionally, the movable cylinder is slidably sleeved on the ventilation tube, allowing the bubble-making device to have a secondary sliding function to increase a movement range of the bubble-making head.

Optionally, the air supply mechanism includes a fan; the base plate is provided with an air channel within the accommodation cavity, and a side wall of the air channel is provided with an air inlet connected to the outside; the fan is installed on the base plate, an air intake end of the fan is connected to the air channel, and the air exhaust port of the fan is connected to the ventilation tube.

Compared with the prior art, the beneficial effect of the bubble-blowing toy provided by the embodiments of the present application lies in: the air guide mechanism is configured to allow the bubble-making head to adapt to the varying liquid level of the foam liquid in the tray, thus addressing the issue of limited bubble production in existing bubble-blowing toys and enhancing the user experience. Specifically, the bubble-blowing toy incorporates an auxiliary floating assembly connected to the bubble-making head, allowing the bubble-making device to adjust its position according to the change of the liquid level. This adjustment ensures that the air outlet remains close to or in contact with the liquid surface of the foam liquid, thereby ensuring that the expelled airflow can fully contact or stir the foam liquid to generate a significant amount of bubbles, enhancing the user experience.

DESCRIPTION OF DRAWINGS

Hereinafter, the detailed implementation of the present application will be further elaborated upon in conjunction with the accompanying drawings and embodiments. In the accompanying drawings.

Figure 1:
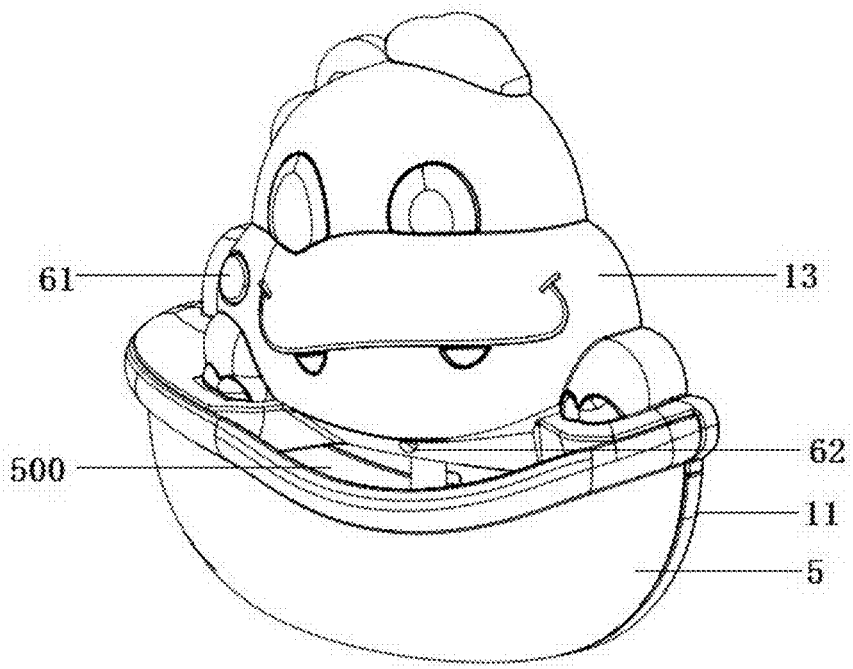
FIG. 1 shows a schematic diagram of the overall structure of the application.
Figure 2:
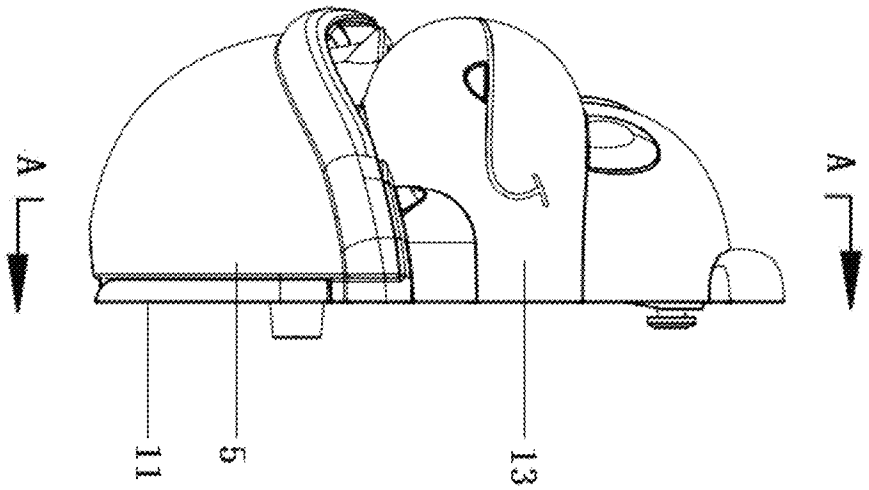
FIG. 2 shows the left side view of FIG. 1.

Each Reference Number in the Drawings is:

1. Housing; 10. Accommodation cavity; 11. Base plate; 110. Power supply cavity; 111. First connecting piece; 112. First fixing groove; 113. Pressing block; 114. Air channel; 115. Air inlet; 116. Third connecting piece; 12. Partition plate; 121. Through hole; 13. Outer shell; 2. Bubble-making device; 20. Air outlet; 21. Ventilation tube; 211. Clamping slot; 212. Second abutment block; 22. Movable cylinder; 220, Air guide mechanism; 221. First abutment block; 222, Second limiting shoulder; 223. Protrusion; 23. Bubble-making head; 231. First limiting shoulder; 232. Second mating position; 3. Auxiliary floating assembly; 30. Flow guide cavity; 31. Support frame; 311. First mating position; 32. Floating ball; 33. Floating block; 34. Floating ring; 4. Air supply mechanism; 41. Fan; 411. Air exhaust port; 42. Fixing frame; 421. Fourth connecting piece; 5. tray; 50. Liquid-carrying cavity; 500. Bubble outlet; 51. Second connecting piece; 52. Second fixing groove; 6. Control panel; 61. Control button; 62. Light-emitting part.

DETAILED DESCRIPTION

The technical solutions in the embodiments of the present application will be clearly and completely described below with reference to the accompanying drawings. Obviously, the described embodiments are only a part of the embodiments of the present application, not all of them. Based on the embodiments of the present application, all other embodiments obtained by those of ordinary skill in the art without any creative work fall within the protection scope of the present application. It can be understood that the accompanying drawings are only for reference and illustration and are not intended to limit the present application. The connections depicted in the drawings are illustrative and do not limit the connection methods.

For clarity, a component that is described as being "connected" to another may be directly connected or may have an intermediate component present. Unless otherwise defined, all technical and scientific terms used herein have the same meaning as commonly understood by one of ordinary skill in the technical field to which the present application belongs. Ordinary skilled artisans in the field can understand the specific meanings of these terms in the context of the present application. The terms used in the description of the present application are only for the purpose of describing specific embodiments and are not intended to limit the present application.

Figure 3:
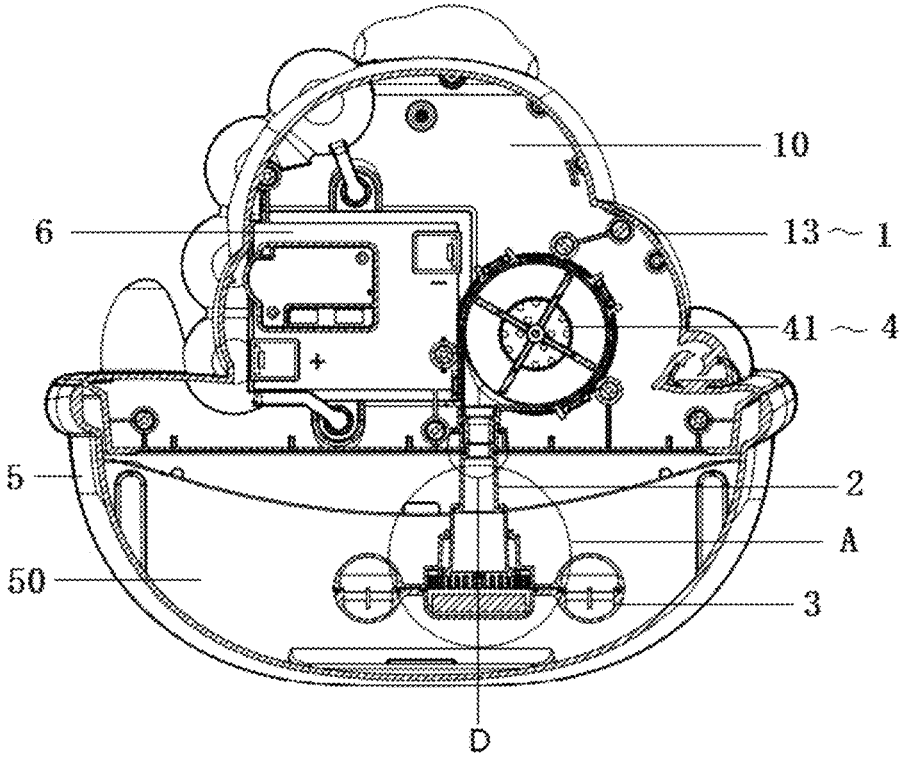
FIG. 3 shows a cross-sectional view A-A of FIG. 2.
Figure 4:
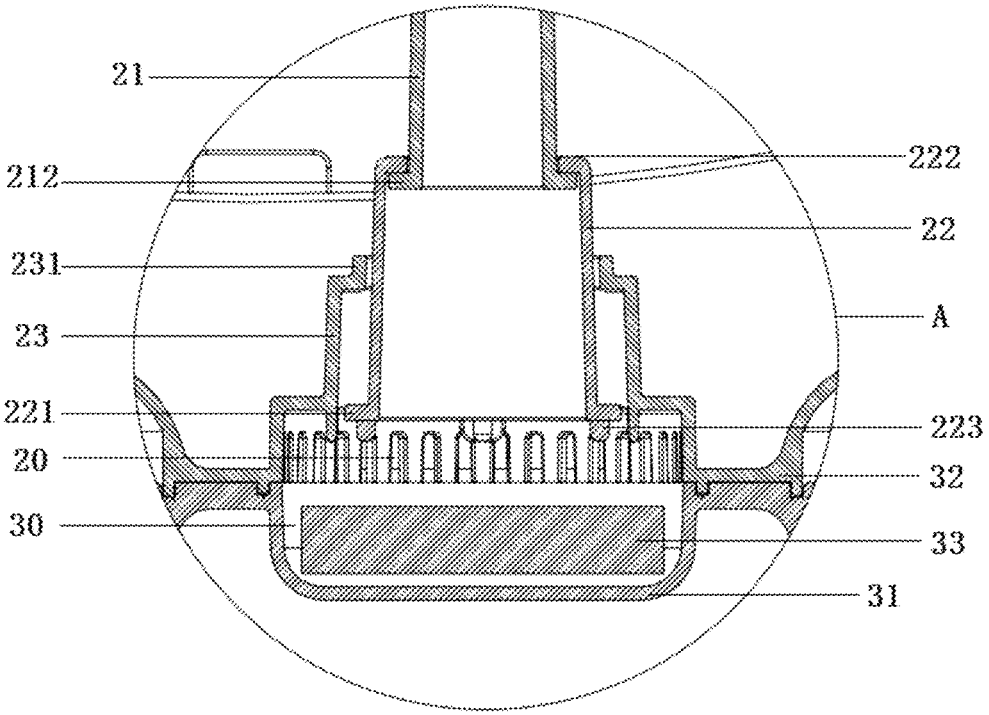
FIG. 4 shows an enlarged view of position A in FIG. 3.
Figure 5:
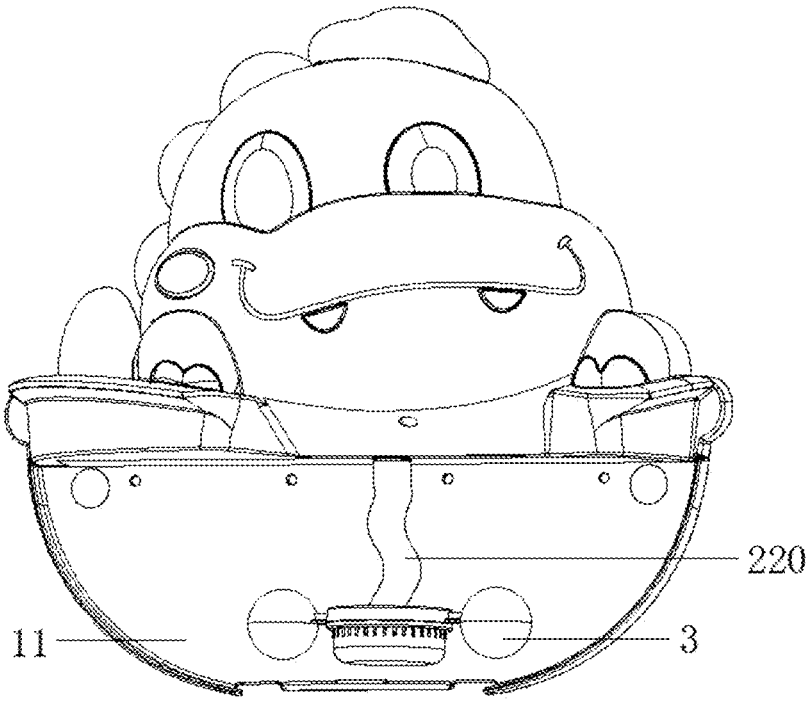
FIG. 5 shows a structural schematic diagram in which the air guide mechanism is a flexible tube.

Referring to FIGS. 1 to 4, a bubble toy includes a housing 1, a bubble-making device 2, an auxiliary floating assembly 3, an air supply mechanism 4, and a tray 5. The air supply mechanism 4 includes an air exhaust port 411 and a fan 41 that guides external air to blow out from the air exhaust port 411. The tray 5 is provided with a liquid-carrying cavity 50 for holding foam liquid, and the liquid-carrying cavity 50 has a bubble outlet 500 connected to the outside. The bubble-making device 2 includes a bubble-making head 23 located in the tray 5 and an air guide mechanism 220 connecting the bubble-making head 23 to the air exhaust port 411. The bubble-making head 23 is provided with an air outlet 20. The air guide mechanism 220 is configured to allow the bubble-making head 23 to adapt to a varying liquid level of the foam liquid in the tray 5. The auxiliary floating assembly 3 is connected to the bubble-making device 2 and contacts the foam liquid, allow the bubble-making device 2 to move with the change in liquid level, thereby maintaining the air outlet 20 of the bubble-making head 23 close to or in contact with the liquid surface of the foam liquid. Referring to FIGS. 4 and 5, the air guide mechanism 220 may be a flexible tube or a telescopic tube structure composed of nested ventilation tube 21 and movable cylinder 22.

Specifically, during use, the tray 5 filled with foam liquid is installed on the housing 1, with the bubble-making device 2 placed in the foam liquid. Under the buoyancy of the auxiliary floating assembly 3, the air outlet 20 of the bubble-making device 2 is kept close to the liquid surface. The air supply mechanism 4 provides airflow to the bubble-making device 2, allowing the airflow to exit from the air outlet 20, contacting or stirring the foam to generate bubbles. The generated bubbles accumulate in the liquid-carrying cavity 50 until they are discharged through the bubble outlet 500.

During use, the foam liquid will gradually reduce, causing the liquid level to drop. Since the air guide mechanism 220 is configured to allow the bubble-making head 23 to adapt to the change in the foam liquid level in the tray 5, it will move downward adaptively due to gravity. Conversely, when the liquid level rises, the bubble-making head 23 will adaptively move upward under the action of buoyancy. Regardless of whether the bubble-making head 23 moves up or down, with the help of the auxiliary floating assembly 3, the air outlet 20 will remain close to the liquid surface.

It should be noted that the position between the air outlet 20 and the liquid level is explained here: during use, the position of the air outlet 20 is related to the buoyancy of the auxiliary floating assembly 3. For example, if the buoyancy is much greater than the own weight of the bubble-making device 2, it allows the air outlet 20 to be positioned above the liquid level. If the buoyancy just offsets the weight of the bubble-making device 2 itself, the air outlet 20 can be partially located below the liquid level, and the manufacturer can set it according to needs. On the other hand, even if the buoyancy of the auxiliary floating assembly 3 is much greater than the weight of the bubble-making device 2, during actual use, if the foam fluctuates, there is still the possibility that the foam liquid will submerge the air outlet 20. Therefore, the position of the air outlet 20 is also related to the fluctuation amplitude of the foam liquid.

In summary, the tray 5 is provided on the housing 1 for filling foam liquid. Since the tray 5 is detachable, it can be replaced at any time, which improves the convenience of use. By installing a movable bubble-making device 2 on the housing 1, it ensures a certain range of movement. Together with the auxiliary floating assembly 3, the bubble-making device 2 can adjust its position following changes in the liquid level and keep the air outlet 20 close to the liquid level. This ensures that the blown air flow can fully contact or stir the foam liquid to generate a large number of bubbles, solving the problem of few bubbles in existing bubble-blowing toys and improving the user experience.

Referring to FIGS. 6 to 9, the air supply mechanism 4 is installed inside the housing 1 to protect it. The base plate 11 is provided with a first connecting piece 111, and the tray 5 has a second connecting piece 51 that corresponds to the first connecting piece 111. One of the first connecting piece 111 and the second connecting piece 51 is a magnet, and the other is a metal that can be attracted by the magnet or a magnet. The first connecting piece 111 and the second connecting piece 51 may be attracted to or detached from each other, allowing the tray 5 to be detachably installed on the housing 1. This arrangement makes it easy for users to disassemble the tray 5 for cleaning or replacing/adding foam liquid.

Referring to FIGS. 6-10, the housing 1 may be formed in one piece or designed with an assembly structure. Such a design is not limited in the present application. For ease of understanding, in this embodiment, the housing 1 includes a base plate 11, a partition plate 12, and an outer shell 13. The partition plate 12 and outer shell 13 are installed on the upper side of the base plate 11, and the partition plate 12, outer shell 13, and base plate 11 enclose to form an accommodation cavity 10, with the underside of the base plate 11 located outside the accommodation cavity 10. The air supply mechanism 4 is installed in the accommodation cavity 10, the bubble-making device 2 is movably installed on the partition plate 12, and the tray 5 is detachably installed on the underside of the base plate 11.

Specifically, this structure facilitates the production and assembly of the housing 1 and also simplifies the installation and maintenance of components such as the air supply mechanism 4, bubble-making device 2, and tray 5. Furthermore, the independently designed accommodation cavity 10 effectively isolates the foam liquid, preventing it from entering the cavity and potentially damaging the air supply mechanism 4.

In order to facilitate the installation of the first connecting piece 111 and the second connecting piece 51, the tray 5 or the base plate 11 is provided with a first fixing groove 112 and a pressing block 113. The first connecting piece 111 locates in the first fixing groove 112, and the pressing block 113 limits and secures the first connecting piece 111 within the first fixing groove 112. A second fixing groove 52 is provided on the base plate 11 or the tray 5, corresponding to the first fixing groove 112. The second connecting piece 51 is embedded in the second fixing groove 52.

Furthermore, the first connecting piece 111 is a magnet and is located on the base plate 11, while the second connecting piece 51 is a T-shaped iron block embedded in the tray 5. The magnet attracts the T-shaped iron block, thereby attaching the tray (5) to the base plate (11). The pressing block 113 is positioned on the base plate 11 to restrict the movement of the magnet and prevent it from detaching.

Figure 6:
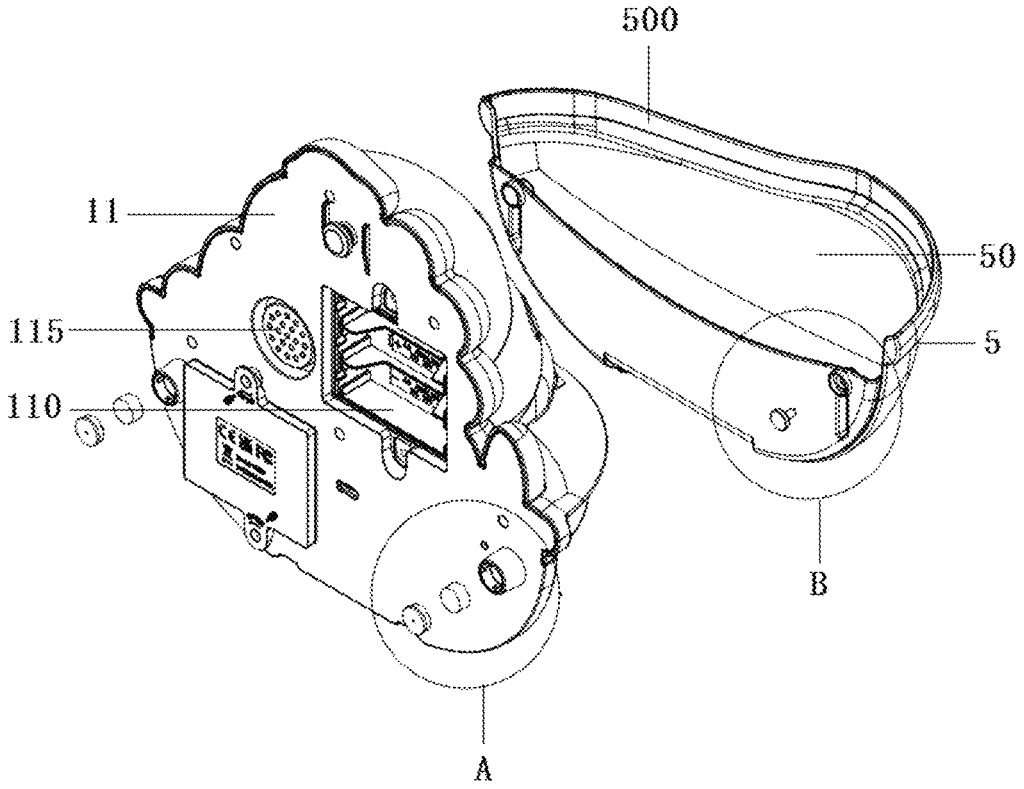
FIG. 6 shows an exploded schematic diagram of FIG. 1.
Figure 7:
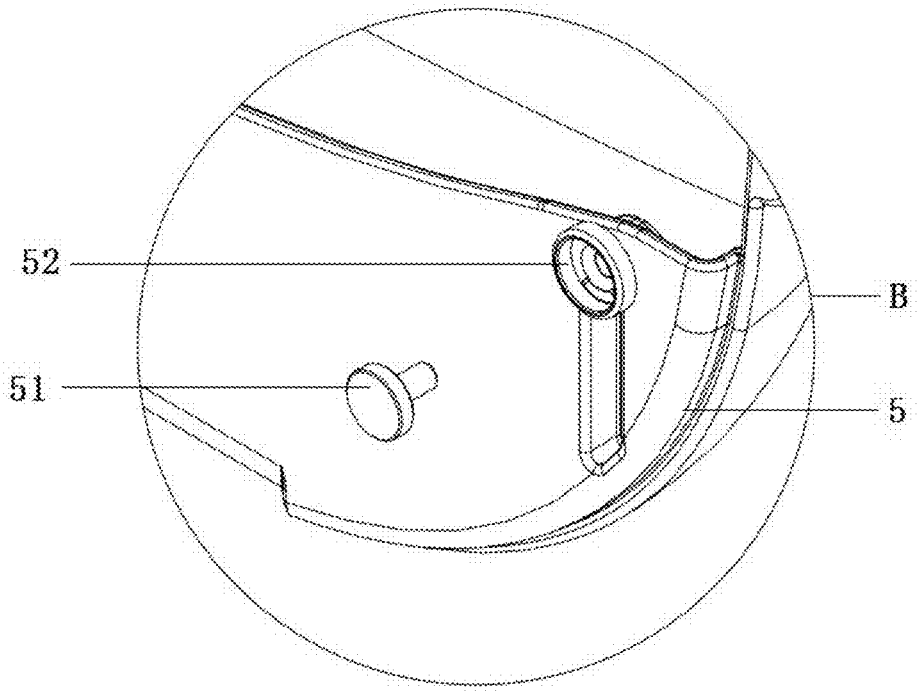
FIG. 7 shows an enlarged view of position B in FIG. 6.
Figure 8:
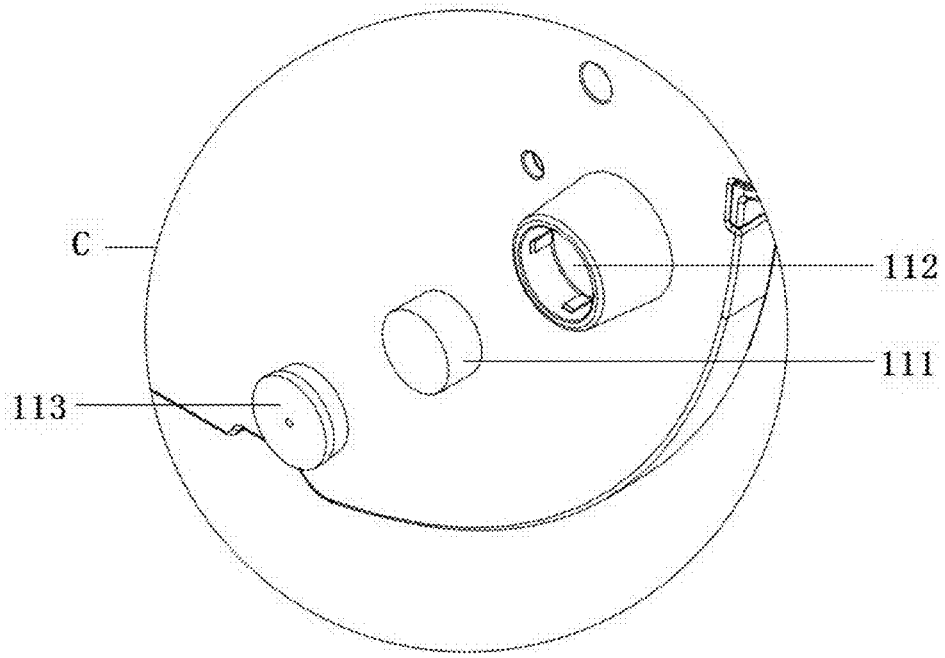
FIG. 8 shows an enlarged view of position C in FIG. 6.
Figure 10:
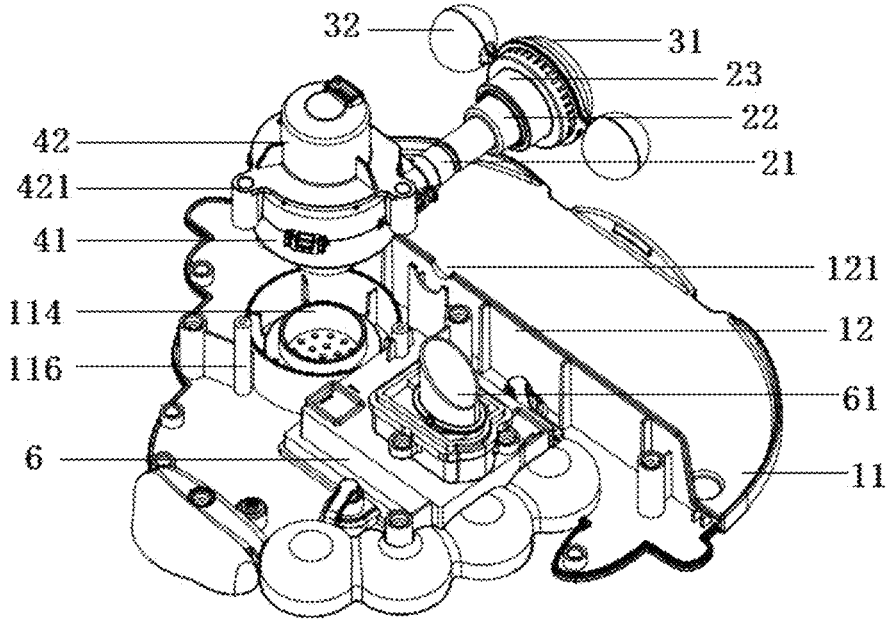
FIG. 10 shows partial structural schematic diagram 2 of the present application.

Referring to FIGS. 4, 6, and 10, for user convenience in controlling the start and stop of the air supply mechanism 4, the present application also includes a control panel 6. The control panel 6 is provided within the accommodation cavity 10 and is electrically connected to the air supply mechanism 4. The base plate 11 is also provided with a power supply cavity 110, within which a battery is installed and electrically connected to the control panel 6.

Specifically, during use, the air supply mechanism 4 may be started and stopped via the control panel 6. For ease of operation, the housing 1 is also provided with a corresponding control button 61. The design of the power supply cavity 110 facilitates the installation and removal of the battery (not shown in the drawings). Corresponding wires may be provided in the power supply cavity 110 to connect the battery and the control panel 6 for power supply. The above technology is relatively common in the field of electronic structures and will not be elaborated here.

Figure 9:
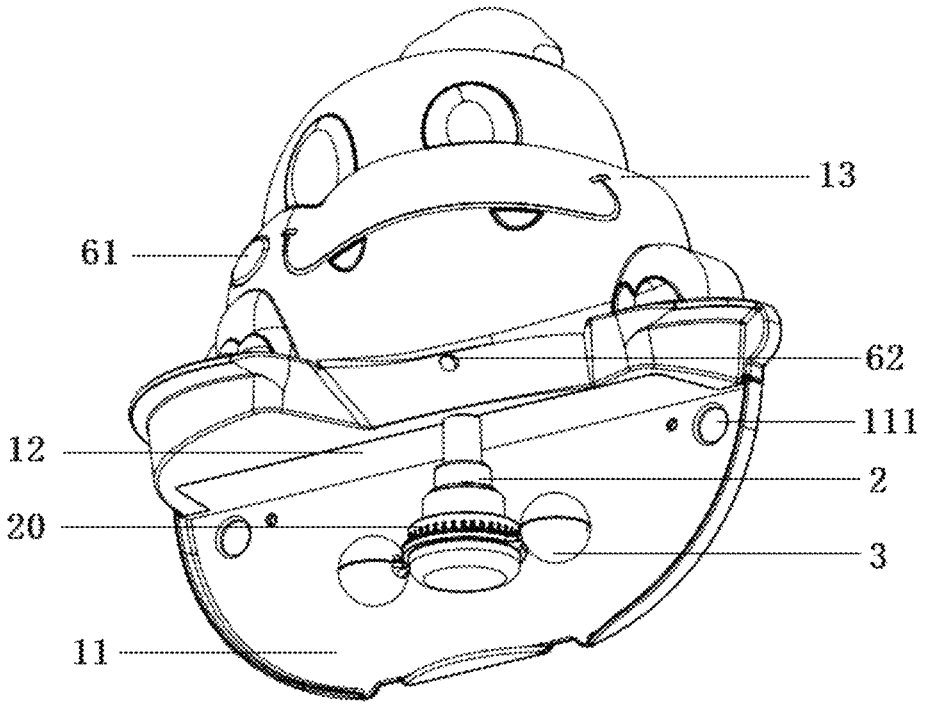
FIG. 9 shows partial structural schematic diagram 1 of the present application.

Referring to FIGS. 1 and 9, in order to improve aesthetics and enhance fun, the present application also includes a light-emitting part 62. The light-emitting part 62 is installed on the outer shell 13 and positioned corresponding to the bubble outlet 500. The light-emitting part 62 is electrically connected to the control panel 6.

Figure 11:
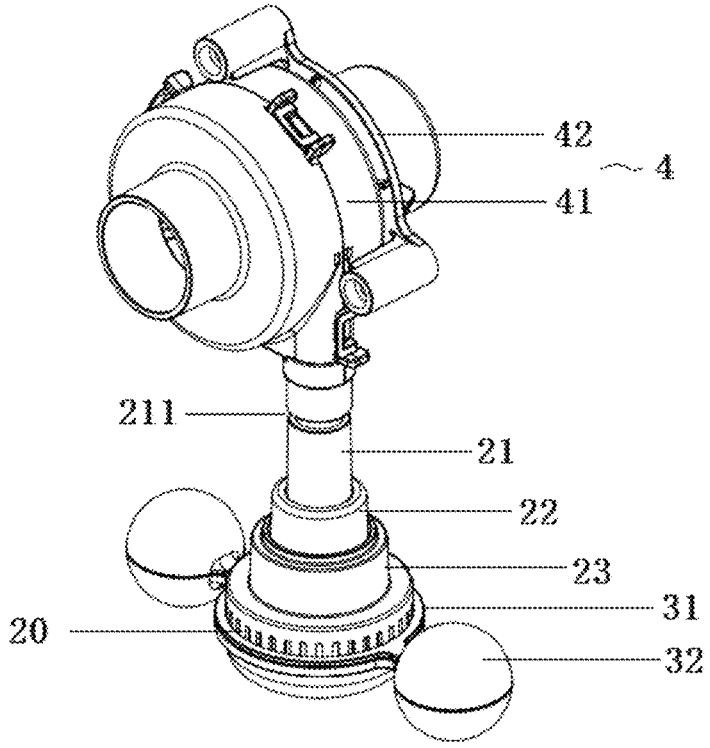
FIG. 11 shows a structural schematic diagram of the bubble-making device, the auxiliary floating assembly, and the air supply mechanism of the present application.

Specifically, during use, the light source emitted by the light-emitting part 62 will illuminate the bubbles at the bubble outlet 500, making the bubbles more vibrant in color and further enhancing the aesthetics. Additionally, multiple light-emitting parts 62 may be installed within the accommodation cavity 10 to create an outline projection of the outer shell 13. This outline projection mapped onto the bubbles may further enhance the fun. The shape of the outer shell 13 may be customized according to actual needs, and this is not limited in the present application. Referring to FIGS. 4, 10, and 11, the air guide mechanism 220 includes a ventilation tube 21 and a movable cylinder 22. The other end of the ventilation tube 21 extends into the liquid-carrying cavity 50 and connects to the movable cylinder 22.

The bubble-making head 23 is slidably sleeved on the movable cylinder 22, allowing it to slide along the cylinder as the liquid level changes.

Figure 14:
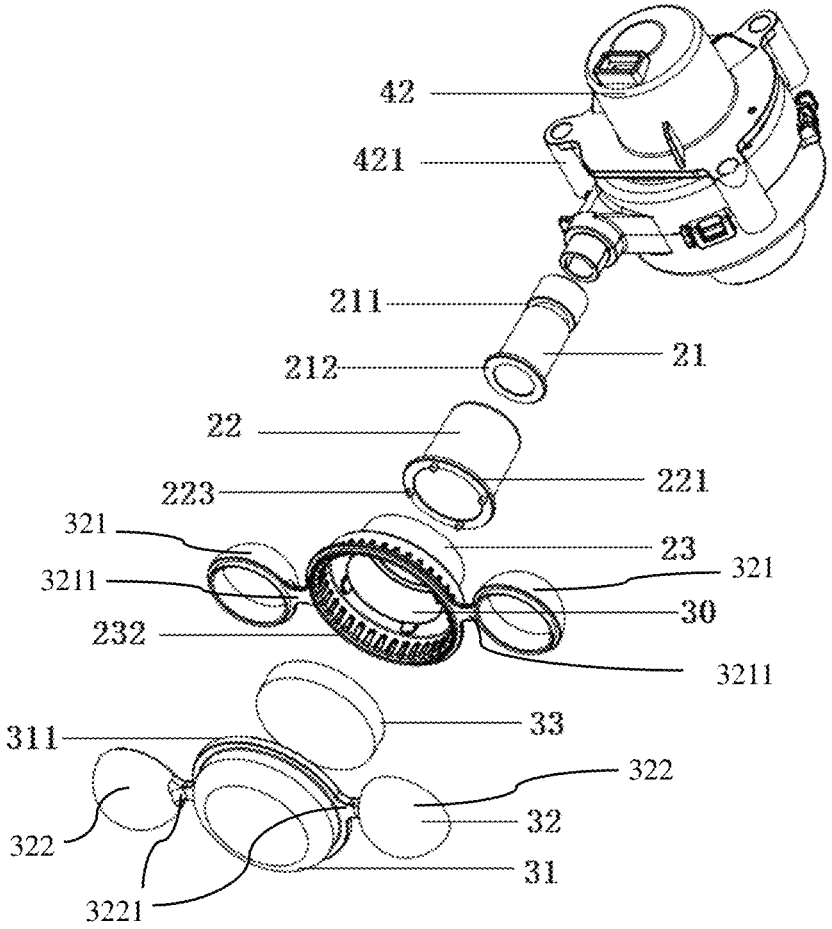
FIG. 14 shows exploded view 2 of FIG. 11.
Figure 15:
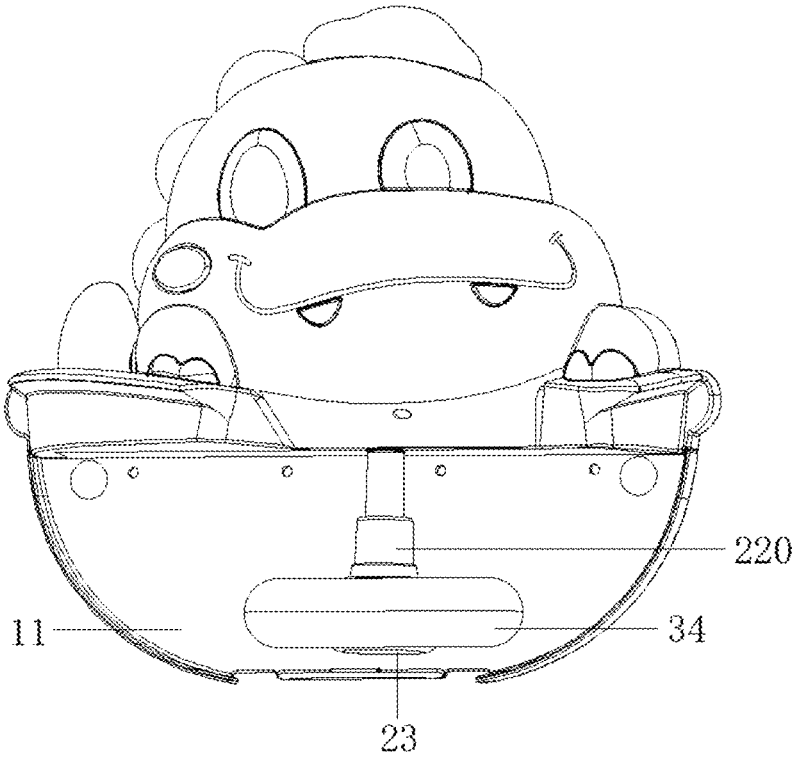
FIG. 15 shows a schematic diagram of the auxiliary floating assembly incorporating a buoyancy ring.
Figure 16:
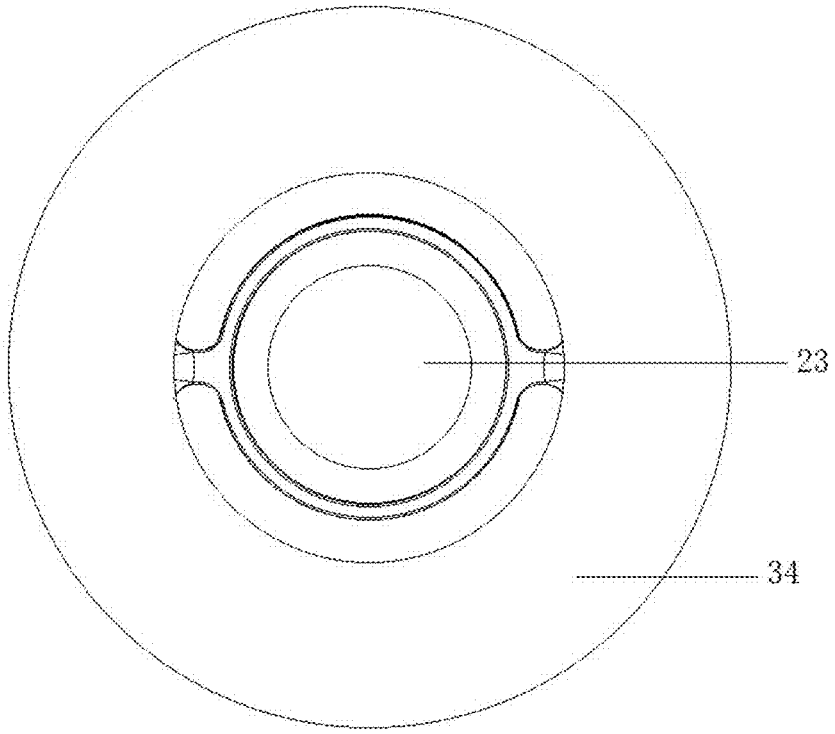
FIG. 16 shows a schematic plan view of the floating ring and the bubble-making head.

To be more specific, referring to FIG. 14, the floating ball 32 includes an upper floating ball shell 321 and a lower floating ball shell 322. The support frame 31 is installed on the bubble-making head 23. The lower floating ball shell 322 is connected to the support frame 31 via a lower extension arm 3221. The upper floating ball shell 321 is connected to the bubble-making head 23 via an upper extension arm 3211. This design facilitates the installation of the bubble-making head 23, support frame 31, and floating ball 32. Additionally, two floating balls 32 are provided, symmetrically arranged on both sides of the support frame 31 and bubble-making head 23.

This configuration also allows the floating ball 32 to form a hollow structure, enabling it to float on the water surface. Furthermore, it facilitates the formation of a flow guide cavity 30 enclosed by the support frame 31 and the bubble-making head 23, with the flow guide cavity 30 being in communication with both the air guide mechanism 220 and the air outlet 20.

Specifically, during operation, the bubble-making head 23 floats on the liquid surface with the assistance of the auxiliary floating assembly 3, ensuring that the air outlet 20 remains close to the liquid surface. The airflow generated by the air supply mechanism 4 passes through the ventilation tube 21 and the movable cylinder 22 in sequence, ultimately exiting through the air outlet 20 to contact or stir the foam liquid.

As the foam liquid is consumed and the liquid level drops, the bubble-making head 23 moves downward along the vertical axis of the movable cylinder 22 due to its own weight and the weight of the auxiliary floating assembly 3. Conversely, when the user replaces the tray 5 with a higher liquid level, the bubble-making head 23 rises along the vertical axis under the buoyancy provided by the auxiliary floating assembly 3. This design allows the bubble-making head 23 to adjust its position in accordance with the liquid level, ensuring that the air outlet 20 remains close to the liquid surface when used in conjunction with the auxiliary floating assembly 3.

Figure 12:
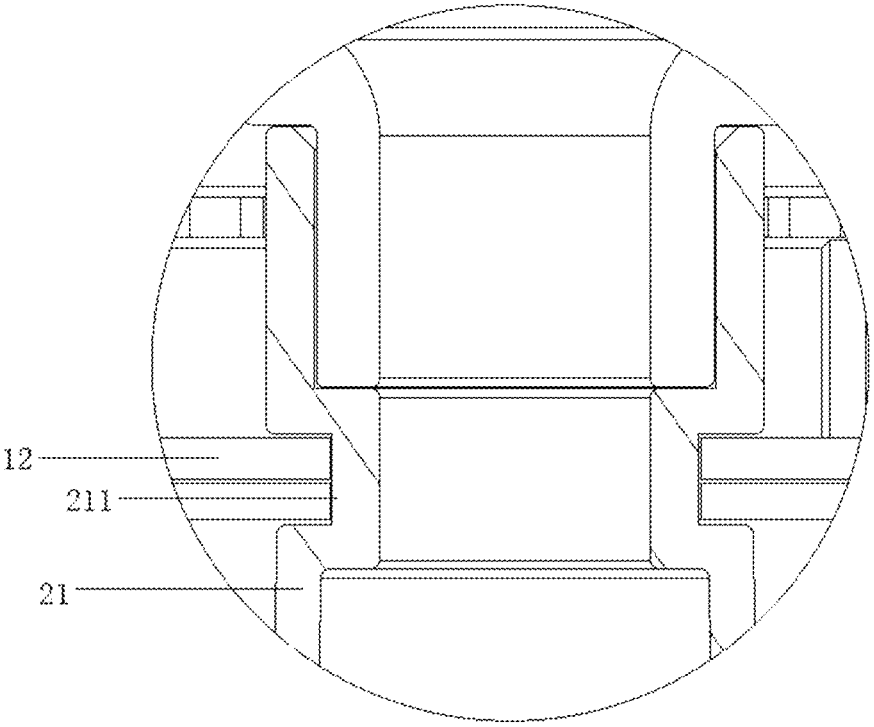
FIG. 12 shows an enlarged view of position D in FIG. 3.

Referring to FIGS. 10 to 12, the partition plate 12 is provided with a through hole 121, and the ventilation tube 21 is provided with a clamping slot 211 on the side wall of one end connected to the air exhaust port 411. The clamping slot 211 mates with the through hole 121 and restricts the ventilation tube, so that the ventilation tube 21 is installed on the partition plate 12 and cannot move vertically, thereby preventing the ventilation tube 21 from being separated from the partition plate 12.

Figure 13:
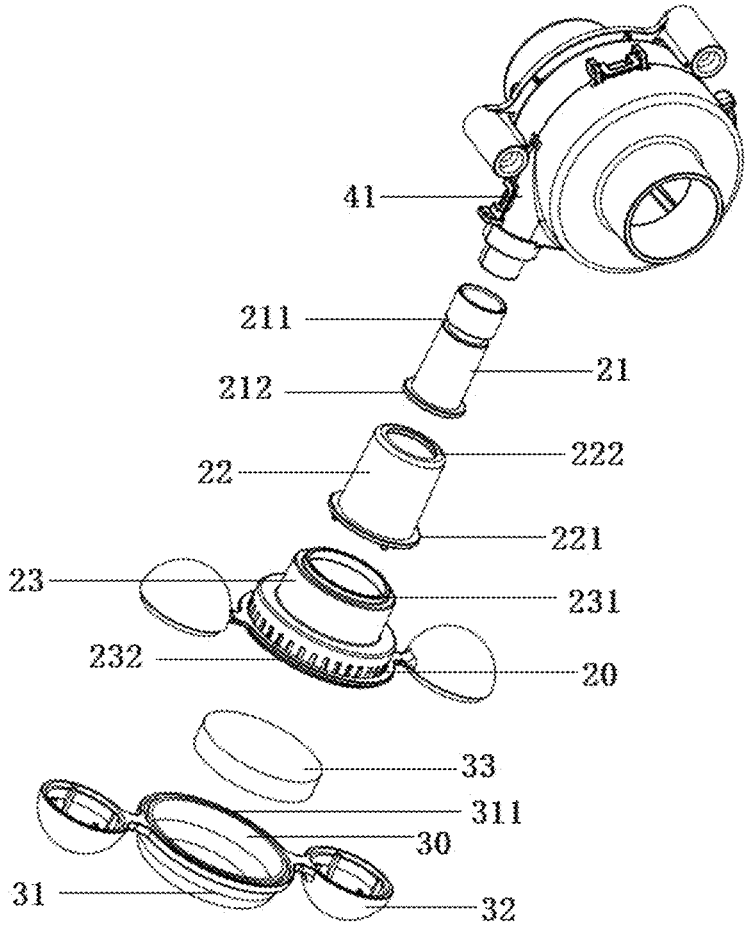
FIG. 13 shows exploded view 1 of FIG. 11.

Referring to FIGS. 4, 13, and 14, a first abutment block 221 is provided on the end of the movable cylinder 22 close to the bubble-making head 23, and a first limiting shoulder 231 is provided on the end of the bubble-making head 23 close to the movable cylinder 22. When the bubble-making head 23 moves downward to a specific position, the first abutment block 221 contacts the first limiting shoulder 231 to prevent the bubble-making head 23 from further descending and disengaging from the movable cylinder 22.

Referring to FIGS. 3 to 4 and FIGS. 10 to 16, the auxiliary floating assembly 3 may be a gas floating component or a physical floating component. For ease of understanding, in the present application, the auxiliary floating assembly 3 includes a support frame 31 and floating ball 32. Multiple air outlets 20 are provided and arranged in a circular array on the bubble-making head 23. The support frame 31 is detachably mounted on the bubble-making head 23, forming a flow guide cavity 30 with the bubble-making head 23. Multiple air outlets 20 are simultaneously connected to the flow guide cavity 30; and the floating ball 32 is mounted on the support frame 31. It should be noted that the floating ball 32 represents just one implementation. In other embodiments, a floating ring 34 or other floating components of varying shapes can be used to effectively replace the floating ball 32.

Specifically, during operation, the airflow provided by the air supply mechanism 4 enters the guide cavity 30 via the ventilation tube 21 and the movable cylinder 22. The airflow is then evenly directed to each air outlet 20 of the bubble-making head 23 due to the obstruction of the flow guide cavity 30. This ensures that each side of the bubble-making head 23 can deliver airflow to contact or stir the foam liquid, resulting in uniform bubble generation and improved efficiency. Additionally, the floating ball 32 provides buoyancy to the support frame 31 and the bubble-making head 23, allowing the air outlets 20 to adapt to changes in the liquid level.

Furthermore, two floating balls 32 are symmetrically installed on both sides of the support frame 31. This design not only increases the buoyancy but also balances the buoyancy on both ends of the bubble-making head 23, effectively enhancing its movement stability.

Referring to FIGS. 3-4 and 10-14, the auxiliary flotation assembly 3 also includes a floating block 33. The floating block 33 is installed within the flow guide cavity 30 and is staggered with multiple air outlets 20. Additionally, a protrusion 223 is located on the end of the movable cylinder 22 close to the bubble-making head 23. When the bubble-making head 23 approaches the movable cylinder 22, the protrusion 223 makes contact with the floating block 33.

Specifically, the design of the floating block 33 serves to block the foam liquid from filling the flow guide cavity 30, thus increasing the weight of the bubble-making head 23, while also enhancing its buoyancy. Meanwhile, the design of the protrusion 223 prevents the floating block 33 from blocking the movable cylinder 22 when the bubble-making head 23 approaches the movable cylinder 22, ensuring that the airflow through the air outlets 20 is not obstructed.

Furthermore, the floating ball 32 and the floating block 33 may be made of materials such as foam board or EVA to provide buoyancy, or they can contain a vacuum chamber (not shown) to achieve the same effect. The present application does not limit these aspects.

Referring to FIGS. 11-14, to enable detachability between the support frame 31 and the bubble-making head 23, the bubble-making head 23 is provided with a second mating position 232, while the support frame 31 has a first mating position 311. The second mating position 232 cooperates with the first mating position 311.

Among them, the second mating position 232 is either an abutment groove or an abutment ring, while the first mating position 311 is a corresponding abutment ring or abutment groove. The support frame 31 is connected to the bubble-making head 23 by having the abutment groove engage with the abutment ring at their respective positions. In this embodiment, the second mating position 232 is an abutment groove, and the first mating position 311 is an abutment ring, which are designed to fit each other.

It is worth noting that, apart from the aforementioned structure, the bubble-making head 23 and the support frame 31 can also be fixed using methods such as adhesive bonding, magnetic connection, threaded connection, etc. The present application does not limit the specific fixing method.

Referring to FIGS. 3-4 and 10-14, the movable cylinder 22 is slidably sleeved on the ventilation tube 21, enabling the bubble-making device 2 to have a secondary sliding function and thereby increasing the movement range of the bubble-making head 23.

It is important to note that in this embodiment: a second abutment block 212 is provided at the end of the ventilation tube 21 close to the movable cylinder 22, and a second limiting shoulder 222 is provided at the end of the movable cylinder 22 close to the ventilation tube 21. When the movable cylinder 22 slides down to a specific position, the second abutment block 212 contacts the second limiting shoulder 222, preventing the movable cylinder 22 from sliding further down and detaching from the ventilation tube 21.

Referring to FIGS. 1 to 7, the ventilation tube 21 is fixedly connected to the movable cylinder 22, and the ventilation tube 21 is a hose made of a flexible material (not shown in the drawings), enabling the ventilation tube 21 to swing on the partition plate 12 and thus increasing the range of motion of the bubble-making head 23.

Referring to FIGS. 1 to 7, the ventilation tube 21 is rotatably connected to the through hole 121 and the movable cylinder 22, and the bubble-making head 23 is also rotatably connected to the movable cylinder 22, allowing the bubble-making head 23 to rotate around the axis of the movable cylinder 22.

Referring to FIGS. 3 and 10, the air supply mechanism 4 includes a fan 41. The base plate 11 has an air channel 114 within the accommodation cavity 10, and the side wall of the air channel 114 is provided with an air inlet 115 that connects to the outside. The fan 41 is installed on the base plate 11, with its air intake end connected to the air channel 114, and its air exhaust port 411 connected to the ventilation tube 21.

Specifically, when the fan 41 is operating, external air is drawn into the air channel 114 through the air inlet 115, and then passes through the air intake end of the fan 41 and exits into the ventilation tube 21 via the air exhaust port 411, and ultimately enters the ventilation tube 21 to provide airflow to the air outlet 20 on the bubble-making head 23. The fan 41 may be a turbine fan or any other type of fan, which is not limited in the present application.

Referring to FIGS. 3 and 10, the air supply mechanism 4 further includes a fixing frame 42, which is positioned beside the fan 41 and presses the fan 41 against the air channel 114. The base plate 11 is provided with a third connecting piece 116 around the air channel 114. The fixing frame 42 is provided with a fourth connecting piece 421 that corresponds to the third connecting piece 116. The third and fourth connecting pieces are interconnected to install the fixing frame 42 on the housing 1, thus achieving the installation of the fan 41.

Specifically, the third connecting piece 116 may be configured as threaded posts, while the fourth connecting piece 421 can be bolts. The threaded posts and bolts engage with each other to securely mount the fixing frame 42 on the housing 1, thereby stably fixing the fan 41 to the base plate 11.

The above descriptions are merely preferred embodiments of the present application and are not intended to limit its scope. Any modifications, equivalent substitutions, and improvements made within the spirit and principles of the present application shall be deemed to fall within the scope of its protection.

What is claimed is:

1. A bubble-blowing toy, characterized by comprising:

an air supply mechanism, comprising an air exhaust port and a fan for guiding external air to blow out from the air exhaust port;

a tray, provided with a liquid-carrying cavity for holding foam liquid, and the liquid-carrying cavity having a bubble outlet connected to an outside;

a bubble-making device, comprising a bubble-making head located in the tray and an air guide mechanism connecting the bubble-making head to the air exhaust port, the bubble-making head being provided with an air outlet, and the air guide mechanism being configured to allow the bubble-making head to adapt to a varying liquid level of the foam liquid in the tray; and an auxiliary floating assembly connected to the bubble-making head to keep the air outlet of the bubble-making head close to or in contact with the liquid level of the foam liquid;

the auxiliary floating assembly comprises a support frame and two floating balls, each of the two floating balls comprises an upper floating ball shell and a lower floating ball shell, the support frame is installed on the bubble-making head, and the lower floating ball shell of each floating ball is connected to the support frame via a respective lower extension arm; the upper floating ball shell of each floating ball is connected to the bubble-making head via a respective upper extension arm;

a flow guide cavity is formed within the support frame and the bubble-making head, and the flow guide cavity is in communication with both the air guide mechanism and the air outlet;

the two floating balls are symmetrically arranged on both sides of the support frame and the bubble-making head.

2. The bubble-blowing toy according to claim 1, characterized by further comprising:

a housing, the air supply mechanism being installed in the housing, the housing being provided with a first connecting piece;

the tray being provided with a second connecting piece corresponding to the first connecting piece; and one of the first connecting piece and the second connecting piece being a first magnet, and an other of the first connecting piece and the second connecting piece being a second magnet or a metal that is capable of being attracted by the first magnet, allowing the tray to be detachably installed on the housing.

3. The bubble-blowing toy according to claim 2, characterized in that the housing comprises a base plate, a partition, and an outer shell;

the partition and the outer shell are installed on an upper side of the base plate, and an accommodation cavity is formed by enclosing the partition, the outer shell, and the base plate, with a lower side of the base plate located outside the accommodation cavity;

the air supply mechanism is installed in the accommodation cavity;

the bubble-making device is movably installed on the partition; and the tray is detachably installed on the lower side of the base plate.

4. The bubble-blowing toy according to claim 3, characterized by further comprising:

a control panel provided in the accommodation cavity and electrically connected to the air supply mechanism;

a power supply cavity provided on the base plate; and a battery installed in the power supply cavity and electrically connected to the control panel.

5. The bubble-blowing toy according to claim 4, characterized by further comprising:

a light-emitting part installed on the outer shell and arranged corresponding to the bubble outlet, and the light-emitting part being electrically connected to the control panel.

6. The bubble-blowing toy according to claim 3, characterized in that the air guide mechanism comprises a ventilation tube and a movable cylinder;

one end of the ventilation tube is connected to the air exhaust port, and an other end of the ventilation tube extends into the liquid-carrying cavity and connects to the movable cylinder; and the bubble-making head is slidably sleeved on the movable cylinder, allowing the bubble-making head to slide along the movable cylinder as the liquid level changes.

7. The bubble-blowing toy according to claim 6, characterized in that the partition is provided with a through hole, a sidewall, on an end connected to the air exhaust port, of the ventilation tube, is provided with a clamping slot, and the through hole is snapped into the clamping slot to prevent the ventilation tube from detaching from the partition.

8. The bubble-blowing toy according to claim 3, characterized in that the air guide mechanism comprises a flexible tube; and one end of the flexible tube is connected to the air exhaust port, and an other end of the flexible tube is connected to the bubble-making head.

9. The bubble-blowing toy according to claim 6, characterized in that the air outlet are provided with multiple air outlets circumferentially arrayed on the bubble-making head; and the multiple air outlets are connected to the flow guide cavity simultaneously.

10. The bubble-blowing toy according to claim 9, characterized in that the auxiliary floating assembly further comprises a floating block installed in the flow guide cavity and being offset from the multiple air outlets, preventing the foam liquid from filling the flow guide cavity to increase a weight of the bubble-making head and also enhance a buoyancy of the bubble-making head;

an end of the movable cylinder close to the bubble-making head is provided with a protrusion, when the bubble-making head approaches the movable cylinder, the protrusion abuts the floating block, preventing the floating block from blocking the movable cylinder.

11. The bubble-blowing toy according to claim 6, characterized in that the movable cylinder is slidably sleeved on the ventilation tube, allowing the bubble-making device to have a secondary sliding function to increase a movement range of the bubble-making head.

12. The bubble-blowing toy according to claim 6, characterized in that the base plate is provided with an air channel within the accommodation cavity, and a side wall of the air channel is provided with an air inlet connected to the outside; the fan is installed on the base plate, an air intake end of the fan is connected to the air channel, and the air exhaust port of the fan is connected to the ventilation tube.

* * * * *